United States Patent [19]

Bowers

[11] 4,163,644

[45] Aug. 7, 1979

[54] SUSPENSION OF COAL IN FUEL OILS

[75] Inventor: Wayne E. Bowers, Byram Township, Sussex County, N.J.

[73] Assignee: The Rolfite Company, Stamford, Conn.

[21] Appl. No.: 899,799

[22] Filed: Apr. 25, 1978

[51] Int. Cl.[2] ..... C10L 1/32

[52] U.S. Cl. ..... 44/51; 44/60; 252/357

[58] Field of Search ..... 44/51, 60; 252/357, 252/51.5 A

[56] References Cited

U.S. PATENT DOCUMENTS

| | | | |
|---|---|---|---|
| 1,431,225 | 10/1922 | Greenstreet | 44/51 |
| 2,550,981 | 5/1951 | Eberz | 44/60 |
| 3,272,746 | 9/1966 | LeSuer et al. | 252/51.5 A |

*Primary Examiner*—Winston A. Douglas

*Assistant Examiner*—Y. Harris-Smith

[57] ABSTRACT

Suspensions of pulverized coal in fuel oil can be stabilized by treating fuel oil with an oil soluble polyamine containing at least two amino groups (or a polyamine which is rendered oil soluble upon reaction with suitable acid), then adding with agitation the desired amount of pulverized coal to the treated fuel oil and finally stabilizing the mixture by adding an oil soluble polycarboxylic acid containing at least two carboxyl groups in an amount sufficient to stabilize the coal-fuel oil mixture.

Suitable amines may be selected from the group consisting of N-alkyl 1,3 diamino propanes and higher N-alkyl amines having more than two amino groups.

Suitable acids may be selected from the group consisting of polymerized fatty acids and alkenyl polycarboxylic acids.

12 Claims, No Drawings

SUSPENSION OF COAL IN FUEL OILS

BACKGROUND OF THE INVENTION

The invention relates generally to the stabilization of suspensions of solids in fluids and in particular to the suspension of pulverized coal particles in heavy fuel oils.

At the present time, many users of fuel oils are faced with the prospect of converting to the use of coal, in part because of the increasing cost of fuel oils and in part to avoid dependence upon liquid fuels which may be in short supply in the future. However, conversion from the use of fuel oils to coal requires substantial investment in costly equipment.

One alternative to the installation of coal-firing equipment is the firing of coal-oil mixtures. It has been recognized that such mixtures may be fired in conventional oil-firing equipment and thereby gaining the advantages of using coal while minimizing investment in new equipment. However, in order for such coal-oil mixtures to be fired successfully, it is essential that a uniform mixture be supplied to the oil burners. One possible approach would be to mix the coal in a pulverized form with fuel oil immediately before firing in order to provide a uniform mixture. Such a procedure is difficult to carry out accurately, and it would be preferable to premix the coal and oil in large quantities and then to supply the oil burners via the conventional oil supply equipment. In order to accomplish such an objective, it is necessary to prevent the settling of coal particles. It is theoretically feasible to divide the coal so finely that when suspended in fuel oil, essentially no settling would occur. However, such a procedure would require the pulverizing of the coal to form particles of near submicron size or smaller. The substantial power input needed as well as the large investment in equipment for size reduction of the coal would offset the savings to be obtained from substituting coal for a portion of the fuel oil being used. It would be preferred to have a method for stabilizing coal-in-oil mixtures in which the coal particles are of a size which will ordinarily settle in a short time unless prevented from settling, i.e., the particles produced by conventional pulverizing equipment, for which the technology and operating parameters are well known and easily utilized.

Suspension of coal particles in liquids has been the subject of a number of U.S. patents. Adams in U.S. Pat. No. 1,939,587 disclosed the use of coal-in-oil suspensions for use as boiler fuel, showing that it was possible to stabilize coal particles ground to less than 200 mesh (Tyler) in oil which contained at least 6% "fixed carbon" (as defined by Adams). Hansley in U.S. Pat. No. 2,668,757 was concerned with dispersing carbon particles generally in organic liquids and disclosed a method of dispersing particles of 1–200 microns in size by forming an alkali metal soap using a fatty acid and an alkali metal such as sodium. Other patents have been concerned with the dispersion of coal in water to facilitate the transportation of coal in the form of water slurries. Examples of such patents are U.S. Pat. No. 3,941,552 and U.S. Pat. No. 3,524,682.

A related subject of considerable commercial interest is the dispersion of sludge particles in the lube oils employed in internal combustion engines. Numerous U.S. patents are concerned with such dispersants, including the following:

U.S. Pat. Nos. 3,172,892; 3,341,542; 3,184,474; 3,347,645; 3,194,812; 3,381,673; 3,194,814; 3,381,022; 3,219,666; 3,594,497; 3,272,746; 3,658,495; 3,340,281.

LeSuer in U.S. Pat. No. 3,172,892 discloses lube oil dispersants which are derived from the reaction of a substituted succinic acid or anhydride with ethylene polyamines. In general it was found that the dispersant effect was related to the size of the molecule produced by the chemical reaction. It is typical of the teachings of LeSuer and others in this field that the dispersants were to be produced by the chemical reaction of acids or anhydrides with amines. Such reactions produce water as a by-product, which is removed before the dispersant is ready for use in lube oils. While such dispersants might be expected to be useful for suspension of coal particles in oil, as will be shown hereinafter, they have been found to be generally ineffective. They are typically used under the dynamic conditions existing in an operating engine when dispersing particles in oil and as will be shown, such dispersants actually have a detrimental effect under the long term static conditions which pertain to the suspension of coal in oil.

The present invention has as one objective the provision of a method for dispersing coal particles at least 70–80% of which are smaller than 200 mesh in fuel oils whereby they may be held in storage for extended periods before being burned.

Another aspect of the invention has as its object a composition of matter comprising a suspension of coal particles at least 70–80% of which are smaller than 200 mesh size in fuel oils which can be held in suspension with minimal settling for periods of up to 60 days.

In still another aspect of the invention, a method of stabilizing coal-in-oil suspensions at low cost is provided which permits firing of coal-in-oil suspensions and taking advantage of the inherent economics of such firing.

SUMMARY OF THE INVENTION

According to the invention, suspensions of finely divided coal particles, generally 80% less than 200 mesh (Tyler) in size, can be prepared in fuel oils and held in suspension for extended periods of time without significant settling of the coal and therefore avoiding intensive remixing of the suspension which would be necessary to overcome settling of the coal.

In general, suspensions of pulverized coal in fuel oils are prepared by treating a fuel oil with a polyamine, adding with agitation the desired amount of pulverized coal, up to about 60% by weight, and then completing the stabilization by adding with mixing a suitable amount of an oil-soluble polyfunctional carboxylic acid containing at least two carboxyl groups.

Suitable amines may be selected from the N-alkyl 1,3 diamino propanes and higher N-alkyl amines having more than two amino groups, examples of which are given hereinafter.

Suitable polyfunctional carboxylic acids may be selected from the group consisting of polymerized fatty acids and alkenyl polycarboxylic acids, examples of which are given hereinafter.

It has been found that any amount of coal up to 60% by weight may be suspended in typical distillate and residual fuel oils and crude oil used for firing boilers and other similar equipment. The coal particles will be pulverized until at least about 70% of the particles are smaller than 200 mesh (Tyler), although larger particles up to about 50 mesh may be tolerated so long as they are not present in amounts greater than about 1.0% by weight. Once prepared, the coal-oil suspensions according to the invention can be held in storage without further mixing for periods up to 60 days before being fired in conventional oil-firing equipment.

More specifically, pulverized coal particles from minimal amounts up to about 60% by weight can be stabilized by adding from about 0.01 to about 1.0 weight % of a suitable polyamine to the oil, followed by adding 0.1 to 3.0 weight % of a suitable polycarboxylic acid to the oil-amine-coal mixture in an amount sufficient to react with the amine. The process preferably is carried out in the temperature range of 110°–170° F. Water produced by the reaction of the amines and acids is not removed and has been found to have a beneficial effect upon the stabilization process.

In another aspect, the invention comprises a suspension of pulverized coal up to 60% by weight in fuel oil which has been stabilized by the sequential addition of a polyamine to the oil followed by a polycarboxylic acid to the coal-oil mixture. Such suspensions have been found to be stable for periods up to 60 days, which permits holding such suspensions in conventional storage means and distribution of the stable suspension by normal facilities for firing in burners designed for fuel oil alone.

DESCRIPTION OF THE PREFERRED EMBODIMENTS

Prior art methods of stabilizing coal in oil mixtures have been found inadequate for suspending coal particles in oil for periods up to 60 days, which is a desirable target when it is desired to extend oil supplies by introducing the burning of coal in the form of coal-in-oil suspensions and if substantial investment in special facilities is to be avoided. As will be shown, suspensions of 80% less than 200 mesh coal particles in fuel oils settle to a large extent within the desired holding period. Such settling is completely unacceptable and must be prevented if the coal-oil suspension is to be pumped to oil burners and fired. While this might be accomplished by vigorous agitation, the cost of doing so and the risk of plugging of storage and delivery equipment if the agitation should be unsuccessful or fail, mitigate against such an approach. Alternatively, the coal and oil could be mixed immediately before firing, but such a method requires a precision of metering and mixing of the ingredients which cannot be accomplished without specialized and expensive equipment. The present invention avoids the difficulties just discussed by stabilizing a suspension of coal particles in oil for extended periods so that the suspensions may be handled in existing fuel oil facilities.

It might be expected that lube oil dispersants known to that art might be useful in stabilization of suspensions of coal particles in oil, but it will be shown in the Examples which follow that such dispersants are not effective and in some instances may actually accelerate the settling process. However, it has been found that the basic ingredients of such dispersants can be used to stabilize coal-oil mixtures but that they must be added in the order required by the process of the invention in order to be effective. It has been found further that the water produced by the reaction of polyamines and polycarboxylic acids according to the invention should not be removed from the coal-oil suspension and, in fact, that the water has beneficial effect on retaining the suspension as produced according to the invention.

Coal is a complex solid containing carbon, sulfur, and hydrogen as well as various metallic elements. Various types of coal are commonly mined and are available for burning in coal-oil suspensions. It is believed that the chemical differences between various coals are not important in determining whether the process of the invention can be applied. Typical coals which have been used include mixtures of Kentucky Blue Gem, West Virginia Loveridge, Pennsylvania Champion and South Indiana Bituminous coals with variable compositions (e.g. Sulfur 1%–3%, Ash Content 5–11%, BTU value 11,500–13,200 BTU/#). As previously mentioned, if coal is pulverized to extremely small size, say to all submicron particles, then little or no stabilization of coal-in-oil suspensions is needed. However, the cost of grinding coal to such small size prohibits such an approach for large-scale applications. According to the invention, coal will be ground until at least about 70% is less than 200 mesh (Tyler) in conventional grinding equipment, such as The Raymond Bowl Mill manufactured by the Raymond/Bartlett-Snow/Ehrsam Division of Combustion Engineering Incorporated. A typical pulverzied coal should have a particle size distribution similar to the following:

| Particle size | % By Weight |
|---|---|
| >50 mesh | 1.0% max. |
| 50<>100 mesh | 4.1% |
| 100<>200 mesh | 22.8% |
| <200 mesh | 72.1% |

From the discussion above, it will be clear that any particles smaller than 50 mesh will be usable and do not present problems in carrying out the process of the invention, but large particles, i.e. those larger than 50 mesh in amounts greater than about 1.0%, and preferably limited to 0.1%, must be removed by screening or other suitable technique and recycled to the grinding process.

Contrary to the prior art reference of Adams, U.S. Pat. No. 1,939,587, the chemical composition of the fuel oil used is not considered of primary importance in the present invention. Coal-oil suspensions are expected to be most useful for large-scale installations, such as electric power station boilers, and thus heavy fuel oils such as #6 oil (having viscosity in the range of 50–300 SSF@ 122° F., API gravity in the range of 15–20, and BTU value in the range of 18,000–18,750 BTU/#.) are most commonly used. However, it is within the broadest scope of the invention to suspend coal or even other solid particles, such as magnesium oxide, in other liquids. For example, coal particles might be suspended in #2 and #4 fuel oils, as well as crude oil, which are much less viscous oils than the residual oils more commonly used. Further, mixtures of the above oils have also been found useful since stable suspensions are easily prepared from such mixtures and viscosity of the stabilized coal oil mixture can be adjusted by initially blending oils to a desired starting oil viscosity. Incorporation of other pigments, such as magnesium oxide, into the stable suspension could be of benefit in reducing acidic pollutants when the fuel mixture is burned.

The residual fuel oils are sufficiently viscous so that they are commonly kept warm to permit handling by conventional equipment. Typical residual oils are stored at about 130°–150° F. (54.4° to 65.5° C.). The temperature of the oils will affect their viscosities and consequently in the comparative Examples which follow, a uniform temperature (as well as a single composition) is used. However, the process of the invention can be used over a range of temperatures. The lower the temperature, and hence the higher viscosity of the mixture, the easier it is to achieve long term stability; however, the reaction of the two stabilizing ingredients may be hindered by employing lower temperatures during preparation. Ambient temperatures, down to about 80° F. (26° C.) could be used for storage of coal oil mixtures especially with lighter oils. Higher temperatures than those necessary to maintain a suitable viscosity are generally undesirable since unnecessary cost is incurred and the oils themselves tend to produce sediment by chemical reaction of the oil constituents. However, the process of the invention is facilitated to the extent that the mixing of coal-oil suspension is more readily accomplished, but on the other hand, reducing the viscosity of the oil by raising the temperature makes the suspension of coal in oil more expensive and difficult. In general, the process of the invention is believed to be operable at temperatures up to about 170° F. (77° C.).

Polyamines which are used in the process of the invention may be selected from a number of species. As will be seen in the following Examples, it has been found that the amines must be added to the oil before the second principal ingredient, a polycarboxylic acid is added. While not necessarily a complete conception of the mechanism, it is believed that the amine hydrogen bonds to the coal particles and then, when some amine groups react with the polycarboxylic acid, the coal particles are incorporated into an ionic salt lattice structure which prevents the particles from settling. The liberation of water during the reaction may have the effects of encouraging formation and stabilization of the three dimensional ionic salt lattice. The amines which have been found particularly useful include members selected from the N-alkyl polyamines, particularly the N-alkyl 1,3 propane diamines or N-alkyl amines having more than two amino groups. Representative of, but not limiting, such polyamines is the group consisting of N-coco diamino propane, N-tallow 1,3 diamino propane, N-oleyl 1,3 diamino propane, N-($C_{11}$–$C_{14}$) 1,3 diamino propanes, N-($C_{15}$–$C_{18}$) 1,3 diamino propanes, N-soya 1,3 diamino propane, N-stearyl 1,3 propane diamine, N-coco 1,4 diamino butane, N-coco diethylene triamine, diethylene triamine, tetraethylene pentamine, triethylene tetraamine, and mixtures thereof. It will be noted that the prefix used in some of the compounds listed indicate their derivation from natural materials and thus some uncertainty as to their precise composition. Such terminology is, however, commonly used by workers in the field. The amount of the amine selected will vary depending upon the quantity and particle size, of the coal to be suspended. Typically, the amine will be present in the range of about 0.01 to about 1.0% by weight on the coal oil mixture. Smaller amounts of the amine will be effective, but will permit settling of a portion of the coal. Greater amounts of amine will be less efficient than the preferred amount. In addition to being wasteful of the amine, there will be excessive consumption of the poly acid which is tied up by its reaction with the amine. Further, excessive use of the stabilizing additives increases viscosity to unworkable levels in the final mixture.

Polyfunctional acids which may be used in the process of the invention are members of a number of species. Preferably, they will be selected from the group consisting of:

(a) Dimerized $C_{18}$ fatty acids having a dimer molecular weight of approximately 565 and containing 36 carbon atoms and having a typical formula as follows: ($R_1$COOH) ($R_2$) C=C($R_3$) ($R_4$COOH) where $R_1$, $R_2$, $R_3$, etc. are alkyl and/or alkenyl straight and branched hydrocarbon chains of variable length, (b) Trimerized $C_{18}$ fatty acids having a trimer molecular weight of approximately 850 and 54 carbon atoms, and having a typical formula as follows: ($R_1$COOH) $R_2$ C=C($R_3$COOH) ($R_4$) C=C ($R_5$) ($R_6$COOH) where $R_1$, $R_2$, $R_3$, etc. are alkyl and/or alkenyl straight and branched hydrocarbon chains of variable length, (c) Polymerized $C_{18}$ fatty acids having polymer molecular weights of approximately 283(x) where X is an integer >3 and contains 18(X) carbon atoms and having a typical formula as follows: $\left(R'\ (COOH)\ R''\right)_x$ where R' and R'' contain 17 carbon atoms collectively and where R' and/or R'' is a branched or straight alkyl or alkenyl hydrocarbon chain, (d) Other dimerized, trimerized, and polymerized fatty acids; said fatty acids having 8–40 carbon atoms, (e) Alkyl substituted succinic acids produced by the hydration of alkyl substitution succinic anhydrides which have the general formula:

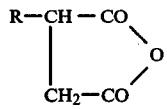

in which R is a substantially aliphatic hydrocarbon chain containing preferably at least about 18 carbon atoms, (f) and mixtures thereof.

It is believed, based on the present experience, that other fatty acids may be used, including dimerized, trimerized, and polymerized $C_8$ and higher fatty acids. Polymerized $C_{18}$ fatty acids have been most extensively investigated to date because they are available commercially in good supply under the trade name of Empol ® acids produced by Emery Industries, Inc.

Further, the polysulfonic acid equivalents of the above named acids may also be useful. These would be equivalent structurally but the —COOH groups would be replaced by —$SO_3H$ groups. Such materials are not currently commercially available. In general, the amount of acid will be approximately that amount required to react stoichiometrically on a molar basis with the amine or with alkaline components produced by reaction of the amine with the coal. Typically, the amount of the acid will be from about 0.1% to about 3.0 by weight of the coal-oil mixture. As with the amine, smaller or larger amounts of the carboxylic acid will be less efficient or too expensive, although such amounts could be employed if the inferior performance could be accepted.

In all of the examples which follow, the procedure followed had certain elements in common. Coal, specifically a mixture of Kentucy, Illinois and Indiana high sulfur bituminous coals, was pulverized in a 20 ton/hour Raymond Bowl Mill to the extent that 77.2% would pass through a 200 mesh (Tyler) screen. Oil having a viscosity of 200 SSU at 100° F. was prepared by blending #4 and #6 fuel oils, 52% of the #4 oil (56.3 SSU at 100° F. and API gravity 29.8) was blended with 48% of #6 oil (having an API gravity of 15.9 and a viscosity of 3150 SSU at 100° F.). A mixture of 40% by weight of the coal in oil was prepared in the temperature range of 80° to 130° F. (26.7°–54.5° C.) by mixing 320 grams of the pulverized coal into 475 grams of the oil while agitating with a Waring blender. During mixing, the temperature rose about 30°–40° F. (16.7°–22.2° C.) from ambient due to the mixing energy required to disperse the coal. After mixing, all the samples were cooled to 80° F. (26.6° C.) and held at that temperature without agitation for a period of twenty-one (21) days. Samples which showed no settling after 21 days were held for an additional 39 days. The amount of coal which settled during the holding periods were determined by measuring the depth of the settled coal in the sample in question and comparing with the depth of the total sample (13 cm).

EXAMPLE 1

A blank sample was prepared by mixing 320 grams of the powdered coal into 480 grams of the 200 SSU oil in a Waring blender for 5 minutes after all the coal was wetted with the oil. After twenty-one days 26.9% of the volume of the mixture was coal that had settled to the bottom of the container.

EXAMPLE 2

A second blank sample was prepared by adding 8 grams of toluene to 480 grams of the 200 SSU oil, followed by 320 grams of the pulverized coal and mixed as in Example One. After twenty-one days, 15.4% of the volume of the mixture was coal that had settled to the bottom of the container.

EXAMPLE 3

A 50% by weight solution of N-tallow 1,3 diamino propane (Duomeen T produced by Armak Industrial Chemicals Division) in #2 fuel oil was prepared by mixing the melted polyamine into the #2 oil at 130° F. (54.4° C.). 0.25% by weight (on the entire coal-oil mixture) of this amine solution (2.0 grams) was added to 480 grams of the 200 SSU oil, followed by the addition of 320 grams of the pulverzied coal. The sample was agitated in the Waring blender 5 minutes after the coal was wetted completely with oil. The stabilization of the coal-oil suspension according to the invention was completed by adding 4.0 grams (0.50% by weight) of a solution of a $C_{18}$ fatty acid dimer and trimer mixture (Empol ® 1054-A). The acid solution was prepared by dissolving an equal weight of the material into toluene to give a 50% solution. After cooling and holding at 80° F. without agitation for twenty-one days, only 2.3% settling was measured. After 60 days, settling was 3.6%.

It has been found that a succinic anhydride derivative such as has been used in the prior art to prepare lube oil dispersants cannot be substituted for a polycarboxylic acid in the stabilization of coal-in-oil suspensions according to the invention, as will be seen in the following example.

EXAMPLE 4

A succinic anhydride derivative was prepared by reacting 500 grams of 2700 molecular weight polyisobutylene with 18.2 grams of maleic anhydride. The mixture was heated to 350°–400° F. (176.7°–204.4° C.) for twenty-four hours under a nitrogen atmosphere in order to form the polybutenyl succinic anhydride. The resulting product was diluted with an equal weight of toluene and filtered through Whatman #3 filter paper. Two percent on the total weight of coal-oil mixture (16.0 g) of the toluene solution was added to a mixture of 320 grams of the pulverized coal in 480 grams of the 200 SSU oil which had been treated with 0.16 grams of tetraethylene pentamine. After twenty-one days, 34.6% of the volume of the mixture was found to be settled coal. This was considerably more settling than found in the control sample (Example 2).

EXAMPLE 5

A succinic acid derivative was prepared by treating 200 grams of the toluene-anhydride solution of Example 4 with 20 grams of water and heating with agitation to incipient boiling for one hour. The excess water was separated after cooling the solution overnight and the acid-toluene mixture was collected.

A coal-oil mixture was prepared by adding 320 grams of coal to 480 grams of oil. As in Example 4, 0.16 grams of tetraethylene pentamine was added, followed by 2% of the acid-toluene solution. After twenty-one days, 1.9% of the volume of the mixture was found to be settled coal. After 60 days 2.2% settling was found.

Comparison of Examples 4 and 5 indicates that, contrary to the prior art which discloses that succinic acid and anhydrides are both useful for preparing dispersants, it has been found that for satisfactory stabilization of coal-oil mixtures, the acid form only is useful. In fact, comparing the results of Example 4 with those of Examples 1 and 2 the use of the succinic anhydride derivative appears to give poorer results than when no additives were used.

EXAMPLE 6

Fifty grams of the anhydride-toluene solution of Example 4 was reacted with 0.657 grams of tetraethylene pentamine by heating and distilling off a toluene-water azeotrope until no water carryover was observed (about 5 hours). Then, toluene was removed by heating the reaction mixture under 40 mm. Hg absolute pressure until distillation ceased. One percent of the polyamide condensation product was dissolved in 480 grams of the test oil, followed by 320 grams of the test pulverized coal. After twenty-one days, it was found that 15.4% of the volume of the mixture was settled coal.

The results of Example 6 show that preparation of a dispersant prior to mixing with the coal-oil mixture is not especially effective. It should be noted that water is generated in the reaction of the amine and the anhydride and removed by azeotropic distillation with toluene so that the dispersant product was free of water.

EXAMPLE 7

Two percent (2%) by weight on the total weight of coal oil mixture of a commercially available polyamide type ashless dispersant, Lubrizol 6401, produced by the Lubrizol Company of Cleveland, Ohio, was dissolved in 480 grams of the test oil and then 320 grams of the pulverized coal was added. After twenty-one days, it was found that 46.2% of the volume of this mixture was settled coal. Thus, the performance of this commercial dispersant was poorer than that of the coal-oil mixture with no dispersant present.

EXAMPLE 8

A particularly effective dispersion according to the invention was prepared by adding 0.15% (by weight on the total weight of coal-oil mixture) of N-coco- 1,3 diamino propane (Duomeen C) to 480 grams of test oil which was warmed to 110° F. (43.3° C.). After the amine addition, 320 grams of pulverized coal was added. The stabilizing process was completed by adding 1.05% by weight of a solution of trimer acid. This acid solution contained 43% by weight of trimer acid (Empol ® 1040) in toluene. After twenty-one days, no significant portion of the mixture was found to be settled coal. After sixty days, settling was also nil.

EXAMPLE 9

The identical amounts of the ingredients of Example 8 were combined a second time, but instead of adding the amine first and then following with the acid, the order of addition was reversed. After twenty-one days, it was found that 26.9% of the mixture was settled coal. Comparing the results of Examples 8 and 9 indicates clearly the importance of adding the amine to the oil before the coal and acid are introduced.

EXAMPLE 10

The same ingredients employed in Examples 8 and 9 were combined again except that the dispersant additives were reacted before being added to the coal-oil mixture, thereby obtaining a dispersant related to those disclosed in the prior art. One hundred thirty-six (136) grams of N-coco 1,3 diamino propane were dissolved in 450 grams of toluene, followed by 300 grams of the trimer acid of Example 8. The mixture was heated, and an azeotropic distillation was carried out over a period of 31 hours, during which time 12.5 grams of water were removed. The reaction product remained dissolved in the toluene except for 14 grams of toluene carried over during the distillation.

The reaction product in toluene was added (1.2%) by weight on the weight of coal-oil mixture to 480 grams of the test oil and followed by 320 grams of the pulverized coal. After twenty-one days, it was found that 19.2% of the volume of the mixture was settled coal. It can be seen that formation of a reaction product which would be expected to have dispersant properties actually has essentially none, compared to the method of the invention, as illustrated by Example 8.

EXAMPLE 11

Three additional coal-oil mixtures were stabilized according to the invention with the results as follows:

| Amine | Acid | % Settling After 21 Days | % Settling After 60 Days |
|---|---|---|---|
| 0.3% octadecylamine | 0.45% of the $C_{54}$ trimer acid of Example 8 but without dilution with toluene. | 6.29 | 8.4 |
| 0.03% tetraethylene pentamine | 0.45% of the $C_{54}$ trimer acid of Example 8 but without dilution with toluene. | Nil | 0.5 |
| 0.03% triethylene tetramine | 0.45% of the mixed dimer and trimer acid of Example 3 but without dilution with toluene. | Nil | Nil |

In each instance, the indicated amount of amine was mixed with 480 grams of the test oil and then 320 grams of the pulverized coal and finally the acid was added, according to the invention.

EXAMPLE 12

A polyacid was prepared by conversion of a polyanhydride resin (PA-18, a product of Gulf Oil & Chemical Company). The polyanhydride resin is a high molecular weight copolymer of maleic anhydride and octadecene-1. Acid content as received was only 2.5%. In 165 grams of #2 fuel oil, 35 grams of the polyanhydride resin were dissolved with heat and agitation. An excess of water (10 grams) was added and the mixture was heated to incipient boiling with agitation for one hour. The residual water was separated overnight and the acid solution in oil was used according to the invention.

0.15% by weight of the amine used in Example 8 was added to 480 grams of the test oil and thereafter 320 grams of the pulverized coal were introduced. The stabilization was completed by adding 3.0% of the acid solution to the mixture. After twenty-one days, it was found that essentially none of the coal had settled. After sixty days, no settling was evident.

EXAMPLE 13

The anhydride precursor solution of Example 12 was used directly instead of the acid product. 0.15% of the amine of Example 8 was added to 480 grams of the test oil and followed by 320 grams of the pulverized coal. 3.0% of the anhydride solution of Example 12 was added to the mixture. After twenty-one days, 26.9% of the mixture was found to be settled coal. It was concluded that the anhydride is not capable of the dispersing action of the equivalent acid in stabilizing a coal-oil mixture.

The foregoing examples are for illustration of the invention and are not intended to limit the scope thereof, as defined by the claims which follow.

What is claimed is:

1. A method of stabilizing a suspension of coal particles in fuel oil comprising:

(a) mixing into fuel oil a predetermined amount of a polyfunctional amine selected from the group consisting of N-alkyl 1,3 diamino propanes and higher N-alkyl amines having more than two amino groups;

(b) adding to the amine-fuel oil mixture of (a) pulverized coal and agitating the resulting mixture to create a suspension of the coal in the fuel oil, said coal being in the form of at least about 70% by weight of particles which are capable of passing through a 200 Tyler mesh screen and containing no more than about 1.0% by weight of particles larger than 50 mesh;

(c) adding to the amine-fuel oil-coal mixture of (b) an amount of a polyfunctional carboxylic acid containing at least two carboxyl groups sufficient to react with the amine of (a) and thereby to stabilize the suspension of pulverized coal in fuel oil.

2. The method of claim 1 wherein said coal is added in an amount from about 1% to about 60% by weight of the coal-oil mixture.

3. The method of claim 1 wherein said polyfunctional amine is selected from the group consisting of N-coco diamino propane, N-tallow 1,3 diamino propane, N-oleyl 1,3 diamino propane, N-($C_{11}$–$C_{14}$) 1,3 diamino propanes, N-($C_{15}$–$C_{18}$) 1,3 diamino propanes, N-soya 1,3 diamino propane, N-stearyl 1,3 propane diamine, N-coco 1,4 diamino butane, N-coco diethylene triamine, diethylene triamine, tetraethylene pentamine, triethylene tetramine, and mixtures thereof.

4. The method of claim 1 wherein said amine is added in an amount from about 0.01 to about 1.0% by weight of the coal-oil mixture.

5. The method of claim 1 wherein said polyfunctional carboxylic acid is selected from the group consisting of:

(a) dimerized $C_{18}$ fatty acids having a dimer molecular weight of approximately 565 and containing 36 carbon atoms and having a typical formula as follows: ($R_1$COOH) ($R_2$) C=C($R_3$) ($R_4$COOH) where $R_1$, $R_2$, $R_3$, and $R_4$ are alkyl and/or alkenyl straight and branched hydrocarbon chains, (b) trimerized $C_{18}$ fatty acids having a trimer molecular weight of approximately 850 and 54 carbon atoms, and having a typical formula as follows: ($R_1$COOH) $R_2$ C=C($R_3$COOH) ($R_4$) C=C ($R_5$) ($R_6$COOH) where $R_1$, $R_2$, $R_3$, $R_4$, $R_5$, $R_6$ are alkyl and/or alkenyl straight and branched hydrocarbon chains, (c) polymerized $C_{18}$ fatty acids having polymer molecular weights of approximately 283 (x) where X is an integer >3 and contains 18(X) carbon atoms and having a typical formula as follows: $\text{-}(R'(COOH)R'')_x$ where R' and R" contain 17 carbon atoms collectively and where R' and/or R" is a branched or straight alkyl or alkenyl hydrocarbon chain, (d) other dimerized, trimerized, and polymerized fatty acids; said fatty acids having 8–40 carbon atoms, (e) alkyl substituted succinic acids produced by the hydration of alkyl substituted succinic anhydrides which have the general formula:

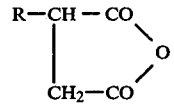

in which R is a substantially aliphatic hydrocarbon chain containing preferably at least about 18 carbon atoms, (f) and mixtures thereof.

6. The method of claim 1 wherein said polyfunctional carboxylic acid is added in an amount from about 0.1 to about 3.0% by weight of the coal-oil mixture.

7. The method of claim 3 wherein said polyfunctional amine is N-coco 1,3 diamino propane.

8. The method of claim 1 carried out at a temperature between about 110° F. and about 170° F.

9. The method of claim 5 wherein said polyfunctional carboxylic acid is ($R_1$COOH) ($R_2$) C=C ($R_3$) ($R_4$COOH) = C($R_5R_6$COOH) where said tribasic acid has a molecular weight of at least about 850 and 54 carbon atoms and produced by the trimerization of a $C_{18}$fatty acid, where $R_1$, $R_2$, $R_3$, $R_4$, $R_5$, and $R_6$ are alkyl and/or alkenyl straight or branched hydrocarbon chains.

10. The method of claim 1 wherein said fuel oil is selected from the group consisting of residual fuels, distillate fuels, crude oil, and mixtures thereof.

11. The method of claim 1 wherein said fuel oil #6 fuel oil.

12. A suspension of coal particles in fuel oil produced by the method of claim 1.

* * * * *